US009003858B1

(12) United States Patent
Lin et al.

(10) Patent No.: US 9,003,858 B1
(45) Date of Patent: Apr. 14, 2015

(54) BENDING DIE HAVING SURFACE MICROSTRUCTURES AND BENDING PUNCH THEREOF

(71) Applicant: National Kaohsiung First University of Science and Technology, Kaohsiung (TW)

(72) Inventors: Bor-Tsuen Lin, Kaohsiung (TW); Chun-Chih Kuo, Kaohsiung (TW)

(73) Assignee: National Kaohsiung First University of Science and Technology, Kaohsiung (TW)

( * ) Notice: Subject to any disclaimer, the term of this patent is extended or adjusted under 35 U.S.C. 154(b) by 0 days.

(21) Appl. No.: 14/190,555

(22) Filed: Feb. 26, 2014

(30) Foreign Application Priority Data

Sep. 30, 2013 (CN) ..... 2013 1 0457253

(51) Int. Cl.

| | |
|---|---|
| ***B21D 24/04*** | (2006.01) |
| ***B21D 22/10*** | (2006.01) |
| ***B21D 35/00*** | (2006.01) |
| ***B21D 22/02*** | (2006.01) |

(52) U.S. Cl.
CPC ..... *B21D 35/001* (2013.01); *B21D 22/02* (2013.01)

(58) Field of Classification Search
USPC ..... 72/47, 53–63, 350–358, 412; 427/135; 428/141
See application file for complete search history.

(56) References Cited

U.S. PATENT DOCUMENTS

| | | | | |
|---|---|---|---|---|
| 3,789,649 | A * | 2/1974 | Clowes | 72/350 |
| 4,581,913 | A * | 4/1986 | Reed | 72/53 |
| 5,318,091 | A * | 6/1994 | Pavoni et al. | 427/135 |
| 5,671,628 | A * | 9/1997 | Halila et al. | 72/53 |
| 6,286,351 | B1 * | 9/2001 | Schulze | 72/60 |
| 6,807,838 | B2 * | 10/2004 | Iwaya | 72/350 |
| 7,066,234 | B2 * | 6/2006 | Sawitowski | 72/47 |
| 7,340,934 | B2 * | 3/2008 | Kurokawa et al. | 72/350 |
| 8,747,683 | B2 * | 6/2014 | Isurugi et al. | 428/141 |

* cited by examiner

*Primary Examiner* — David B Jones
(74) *Attorney, Agent, or Firm* — Muncy, Geissler, Olds & Lowe, P.C.

(57) ABSTRACT

Provided are a bending die having surface microstructures and a bending punch thereof applicable to stamping processing to bend a blank to form a shape. The bending die includes a lower die, an upper die, and a workpiece placing piece. The lower die includes a die, and the die includes a forming surface. The upper die includes a bending punch, the bending punch stamps a blank placed on the die in a back and forth stroke, and the bending punch includes a working portion coming into contact with the blank during stamping. The workpiece placing piece is disposed between the upper die and the lower die and used to position or/and press the blank placed on the die. A plurality of microstructures are disposed on the forming surface and/or on the surface of the working portion.

8 Claims, 9 Drawing Sheets

BENDING DIE HAVING SURFACE MICROSTRUCTURES AND BENDING PUNCH THEREOF

CROSS-REFERENCE TO RELATED APPLICATION

This application claims the benefit of China Patent Application No. 201310457253.7, filed on Sep. 30, 2013, which is hereby incorporated by reference for all purposes as if fully set forth herein

BACKGROUND OF THE INVENTION

1. Field of Invention

The present invention relates to a bending die having surface microstructures and a bending punch thereof, and more particularly to a bending die in which microstructures are disposed on a surface of a working portion of a bending punch and on a forming surface of a die and a bending punch thereof.

2. Related Art

In the recent decade, with the rapid development of the electronics industry, the sales of commodities like consumer electronic products such as mobile phones and notebook computers increase significantly. These commodities tend to become small in volume, light in weight, high in strength, and high in heat dissipation performance in recent years, which require that the components thereof also need to be made of metal and in miniature sizes. However, component production adopting semiconductor or unconventional processes is subject to disadvantages such as high equipment cost, limited materials used in processes, small depth-to-width ratios of products, and difficulties in making components of 3D shapes.

Metal forming processing is a key technology for mass production of metal parts in conventional manufacturing, which has advantages such as high production efficiency, material saving, high precision, near net shape production, desirable mechanical properties of finished products, unlimited material applications, and simplified design of parts, and meets the conceptual requirements for environmental friendliness of green industries, so that the applications of metal forming in component microfabrication have drawn more and more attention, which is called metal micro-forming.

Bending processing in metal forming processing refers to that metal sheets are bent and plastically deformed into demanded shapes and angles through processing of bending tools. When external forces are removed, the bent, permanent deformations are still kept. FIG. 1A to FIG. 1C are schematic views of a common bending die of a V-shaped bending type and a stamping process thereof. For a bending die 10, a blank 11 (for example, a metal sheet) is first placed on a forming surface 121 of a die 12 and then a bending punch 13 is performed a back and forth stroke towards a die 12 to stamp the blank 11, so that after the blank 11 is pressed and bent, the bottom surface of the blank 11 is shaped by the forming surface 121, and the top surface of the blank 11 is shaped by the bending punch 13, so as to obtain a demanded V-shaped shape finished product or semi-finished product.

In addition, FIG. 2A to FIG. 2C are schematic views of a common bending die of an L-shaped bending type and a stamping process thereof. For a bending die 10', a blank 11' first is placed on a forming surface 121' of a die 12' a blank holder 14 is positioned and held the blank 11' and then a bending punch 13' is performed a back and forth stroke towards the die 12' to stamp the blank 11', so that after the blank 11' is pressed and bent, the bottom surface of the blank 11' is shaped by the forming surface 121', and the top surface is shaped by one side of the bending punch 13', so as to obtain a demanded L-shaped finished product or semi-finished product.

Further, FIG. 3A to FIG. 3C are schematic views of a common bending die of a U-shaped bending type and a stamping process thereof. For a bending die 10", a blank 11" first is placed on a forming surface 121" of a die 12", and then a bending punch 13" is performed a back and forth stroke towards the die 12" to stamp the blank 11", so that after the blank 11" is pressed and bent, the lateral surface of the blank 11" is shaped by the forming surface 121", the bottom surface of the blank 11" is shaped by a blank protrusion plate 15 of a protrusion mechanism (not shown), and the top surface is shaped by the bending punch 13", so as to obtain a demanded U-shaped shape finished product or semi-finished product.

After the bending dies 10, 10', and 10" are performed bending and stamping processing on a blank, without causing a crack on the bending corner of the blanks 11, 11', and 11", after the blanks 11, 11', and 11" are removed from the bending dies 10, 10', and 10", a deformation phenomenon of springback inevitably occurs to the bending, causing a change in the size of the finished product and in consequence unable to meet the standards. Therefore, it is usually necessary to perform techniques such as secondary shaping and processing to make the bending angle accurate.

SUMMARY OF THE INVENTION

The object of the present invention is to provide a bending die having surface microstructures and a bending punch thereof, in which microstructures are disposed on a forming surface of a die and/or a surface of a working portion of a corresponding punch thereof, so as to reduce the springback amount of a sheet metal blank after stamping and bending.

To achieve the above object, the present invention provides a bending die having surface microstructures, applicable to stamping processing to bend a blank to form a shape. The bending die comprises an upper die, a lower die, and a workpiece placing piece. The lower die comprises a die, and the die comprises a forming surface. The upper die comprises a bending punch, the bending punch stamps a blank placed on the die in a back and forth stroke, and the bending punch comprises a working portion coming into contact with the blank during stamping. The workpiece placing piece is disposed between the upper die and the lower die, and used to position or press the blank placed on the die. A plurality of microstructures are disposed on the forming surface of the die and/or on the surface of the working portion of the bending punch. The microstructures are intersecting grooves disposed inclined relative to the stamping direction, parallel grooves disposed perpendicular to the stamping direction, and slots or concaves in various shapes.

In an embodiment, the forming surface at least has a wall surface turning position, and the plurality of microstructures is disposed on the wall surface turning position and/or a neighboring wall surface region thereof.

In an embodiment, the surface of the working portion at least has a turning portion, and the plurality of microstructures is disposed on the turning portion and/or a neighboring surface region thereof.

In an embodiment, an included angle is provided between two adjacent wall surfaces of the wall surface turning position, or a fillet, a concave angle or an oblique angle is provided between two adjacent wall surfaces of the wall surface turning position.

In an embodiment, the microstructures are arranged at intervals, the shapes of the cross-sections of the intersecting grooves of the microstructures are approximately column-shaped. V-shaped or arc-shaped.

The present invention is characterized in that a plurality of microstructures disposed on the surface of a working portion of a bending punch, and/or on the surface of a working portion of a bending punch and a forming surface of a corresponding die of the present invention can reduce the force of friction between a processed blank and a bending die during bending, so as to make a sheet metal blank to completely reach plastic deformation during bending and forming, reduce cases of uneven stress distribution on the sheet metal blank, and reduce the springback amount of the sheet metal blank.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

The embodiments of the present invention will be illustrated below with reference to the accompanying drawings.

Figure 1A:
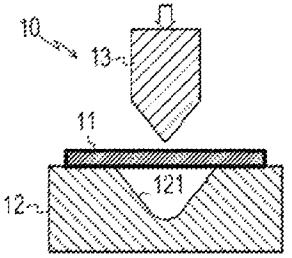
FIG. 1A ( PRIOR ART )
FIG. 1A to FIG. 1C are schematic views of a bending die of a V-shaped bending type and a stamping process thereof in the prior art.
Figure 1B:
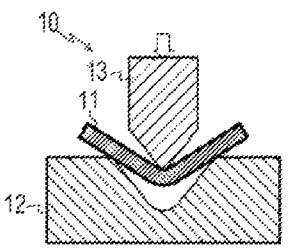
FIG. 1B ( PRIOR ART )
Figure 1C:
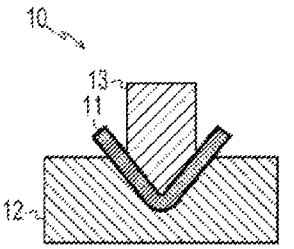
FIG. 1C ( PRIOR ART )
Figure 2A:
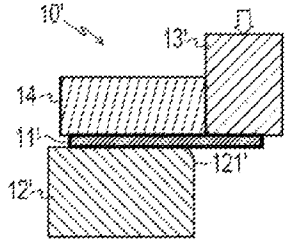
FIG. 2A ( PRIOR ART )
FIG. 2A to FIG. 2C are schematic views of a bending die of an L-shaped bending type and a stamping process thereof in the prior art.
Figure 2B:
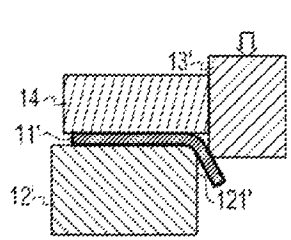
FIG. 2B ( PRIOR ART )
Figure 2C:
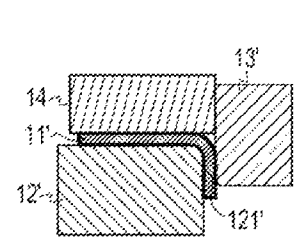
FIG. 2C ( PRIOR ART )
Figure 3A:
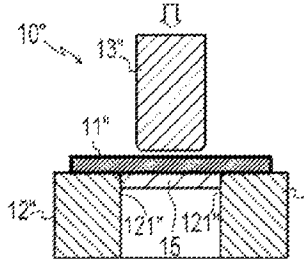
FIG. 3A( PRIOR ART )
FIG. 3A to FIG. 3C are schematic views of a bending die of a U-shaped bending type and a stamping process thereof in the prior art.
Figure 3B:
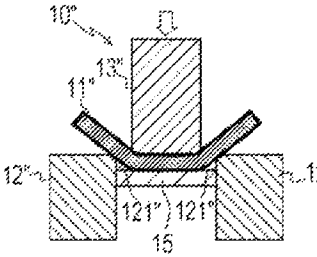
FIG. 3B( PRIOR ART )
Figure 3C:
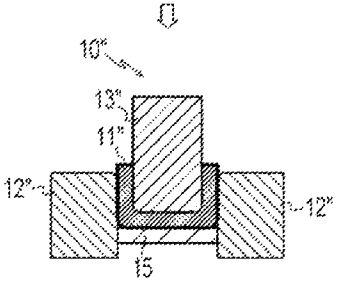
FIG. 3C( PRIOR ART )
Figure 4A:
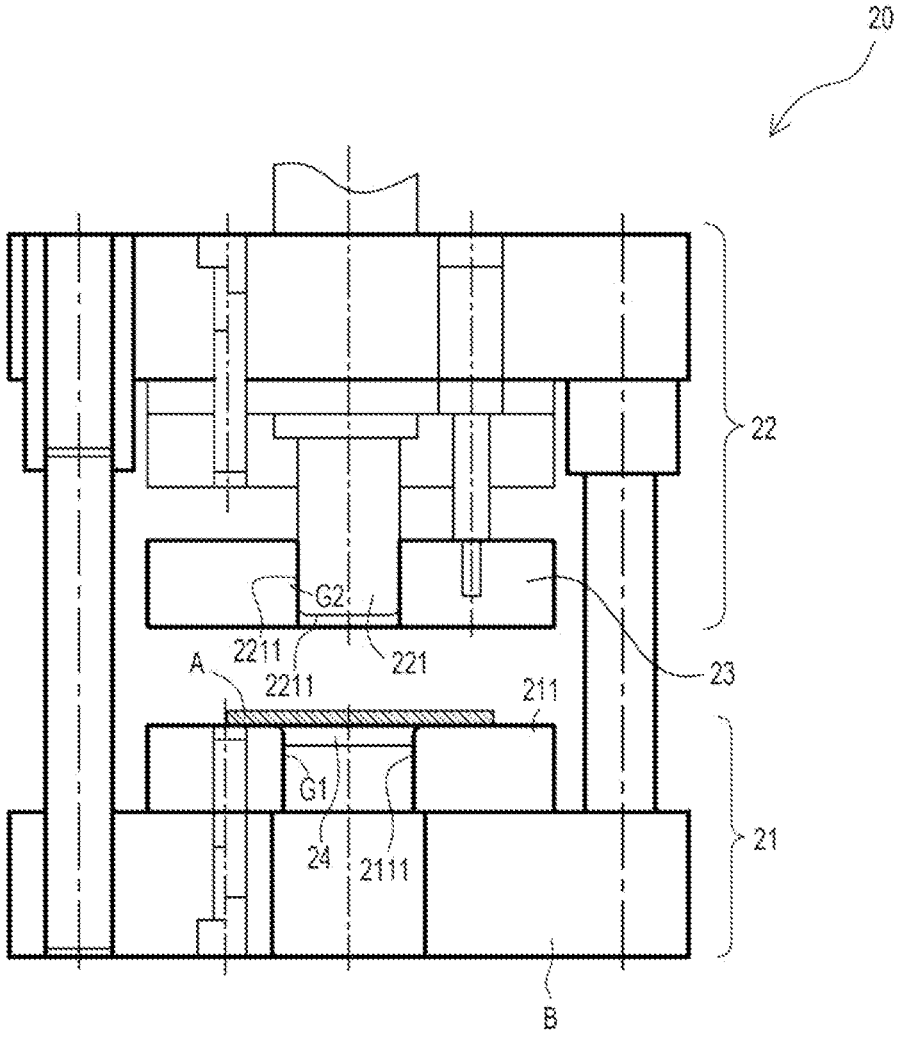
FIG. 4A is a schematic view before a bending punch performs a bending work on a blank according to an embodiment of the present invention.
Figure 4B:
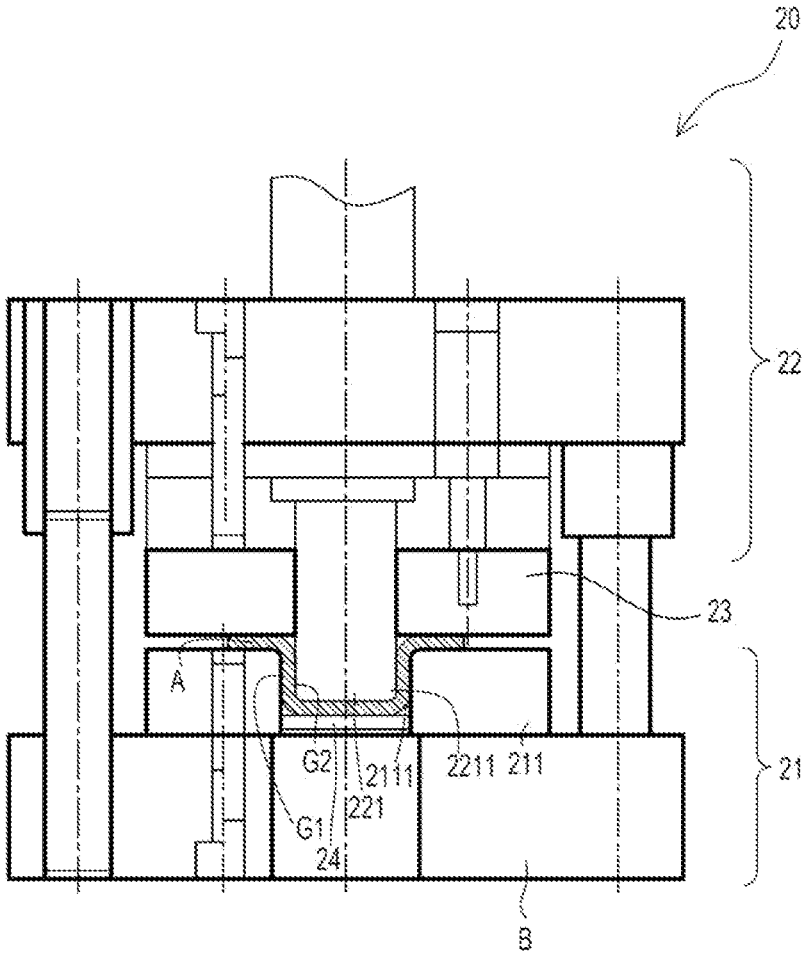
FIG. 4B is a schematic partial view of a bending punch of a bending die in FIG. 4A performs a bending work on a sheet metal blank.

Please first refer to FIG. 4A and FIG. 4B, in which FIG. 4A is a schematic view before a bending punch performs a bending work on a blank according to an embodiment of the present invention, and FIG. 4B is a schematic partial view when a bending punch of a bending die in FIG. 4A performs a bending work on a sheet metal blank. In this embodiment, a bending die 20 is applicable to common stamping and processing equipment and is used to bend a blank A (generally a metal sheet) to form a shape. The related mechanisms and operation principles of the stamping processing equipment are well known to persons skilled in the art, which are therefore no longer elaborated. The bending die 20 of the present invention includes a lower die 21, an upper die 22, and a workpiece placing piece 23. The lower die 21 includes a die 211, and the die 211 is disposed on a die base B and includes a forming surface 2111. The lower die 21 also includes a blank protrusion plates 24 of protrusion mechanisms (not shown) configured inside the forming surface 2111 and at the bottom of the blank A, so as to shape the blank A and release the blank A from the die. The upper die 22 includes a bending punch 221, the bending punch 221 presses the blank A placed on the die 211 in a back and forth stroke by adopting the power of a stamping press (not shown), and the bending punch 221 includes a working portion 2211 coming into contact with the blank during stamping. The workpiece placing piece 23 is disposed between the upper die 22 and the lower die 21, and used to position or press the blank A placed on the die 211, so that the bending punch 221 stamps a correct processing position on the blank A. A plurality of microstructures G1 and G2 are disposed on the forming surface 2111 (effective forming work surface) or the surface (effective forming work surface) of the working portion 2211 or the forming die surface 2111 and the surfaces of the working portion 2211. The sizes and depths of these microstructures G1 and G2 differ depending on the factors such as the hardness of the blank A and the size of the bending die. However, those disposed on the forming surface 2111 and/or the surface of the working portion 2211 and capable of keeping the required strength of the bending die and reducing the force of friction between the blank A and the bending die during stamping and forming shall fall within the scope of the present invention.

Figure 5:
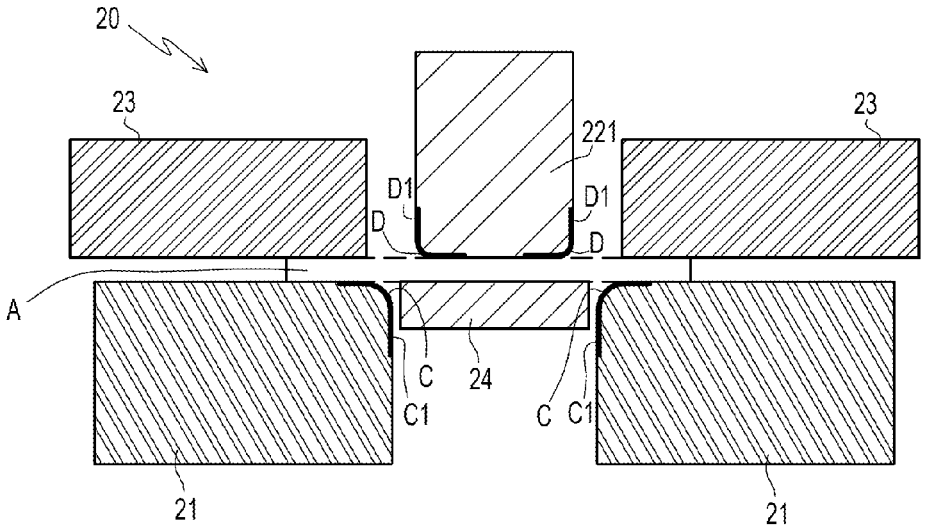
FIG. 5 is a schematic sectional view of the positions of microstructures on the surface of a working portion of a bending punch and a forming surface of a die in the U-shaped bending die according to an embodiment of the present invention.
Figure 6:
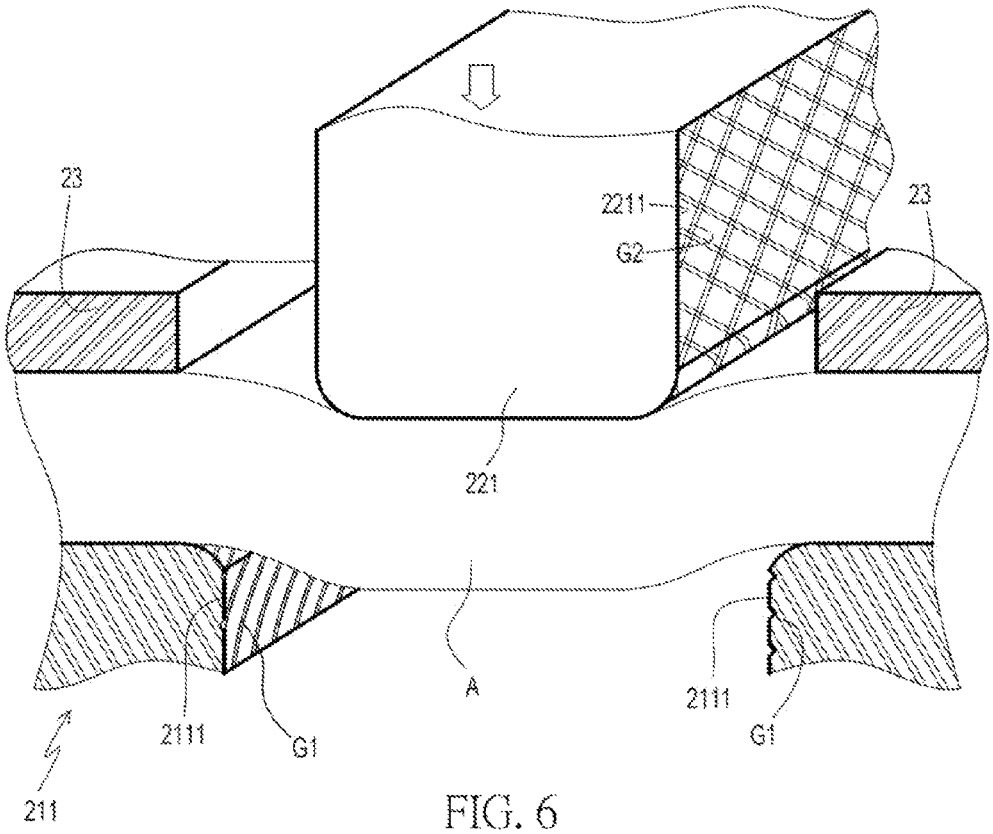
FIG. 6 is a schematic sectional perspective view of the microstructures on the surface of a working portion of a bending punch and a forming surface of a die according to the embodiment in FIG. 5, where the microstructures of the punch are intersecting groove arrangement, and the microstructures of the die are oblique parallel arrangement.

Please refer to FIG. 5 and FIG. 6 then, in which FIG. 5 is a schematic view of the positions of microstructures on the surface of a working portion of a bending punch and a forming surface of a die in the U-shaped bending die according to an embodiment of the present invention, and FIG. 6 is a schematic view of the microstructures on the surface of a working portion of a bending punch and a forming surface of a die according to the embodiment in FIG. 5. In this embodiment, the microstructures G2 on the bending punch 221 are intersecting arrangement, and the microstructures G1 on the die 211 are oblique parallel arrangement; however, the present invention is not limited to this implementation aspect in practical applications. The blank A is positioned and pressed on the die 211 by the workpiece placing piece 23 (blank holder), the bending punch 22) stamps downwards corresponding to the middle of the forming surface 2111 of the die 211, and is held against the blank protrusion plate 24 of a protrusion mechanism (not shown). The forming surface 2111 at least has a wall surface turning position C. The plurality of microstructures G1 on the die 211 are disposed on the wall surface turning position and a neighboring wall surface region C1 thereof. The surface of the working portion 2211 at least has a turning portion D, and the plurality of microstructures G2 of the bending punch 221 are disposed on the turning portion and a neighboring surface region D1 thereof.

Figure 7:
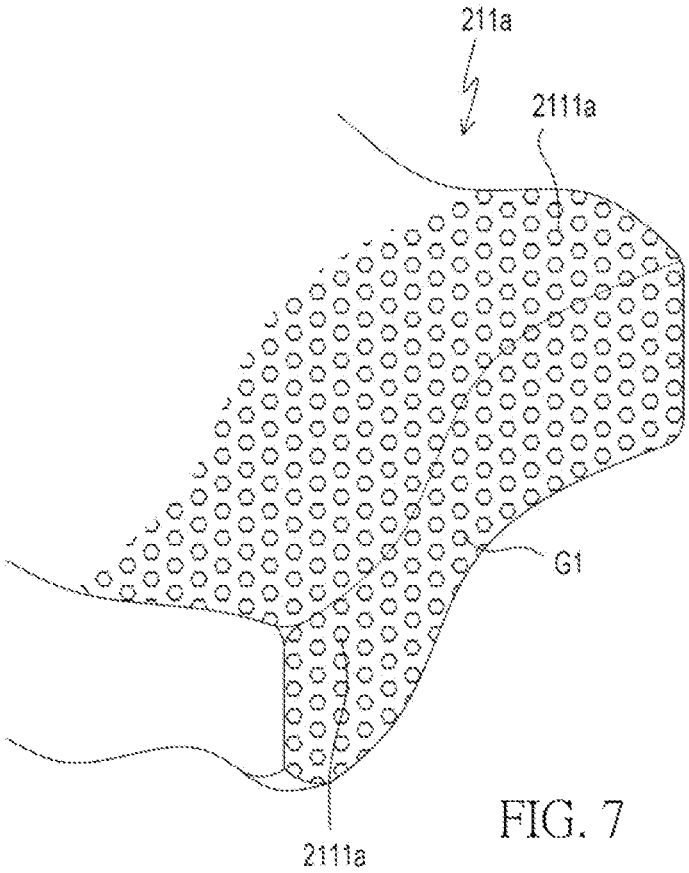
FIG. 7 is a schematic view of the microstructures of a die when the form in the embodiment of the microstructures of the bending punch and die is a curved surface according to an embodiment of the present invention.

Please refer to FIG. 7 then, in which FIG. 7 is a schematic view of the microstructures of a die when the form in the embodiment is a curved surface according to an embodiment of the present invention. The forming surface 2111*a* on the die 211*a* is a curved surface or an irregular surface. The above microstructure G1 may be the pattern of a plurality of concaves. Of course, the corresponding bend punch thereof that is not shown may also have the same features of the curved surface and concave microstructures corresponding to the forming surface 2111*a*. In addition, the microstructures G1 may be the pattern of a plurality of grooves or the pattern of a plurality of concaves, or the pattern of a combination a plurality of grooves and a plurality of concaves. Moreover, the groove microstructures may be the aspects of being arranged intersecting each other or arranged parallel to each other. The plurality of concave (may be approximately circular, elliptic, square, or in other geometric shapes and other irregular shapes) microstructures are suitable to be disposed on the surface of a forming surface with a curved surface or the surface of a working portion of a curved surface or irregular surface; however, the present invention is not limited thereto. In other words, by adopting the current processing technology, it is out of the question to process groove microstructures on a curved surface or an irregular surface, or to process concaves of circular, elliptic, square shapes, other geometric shapes, and other irregular shape on a plane.

Figure 8:
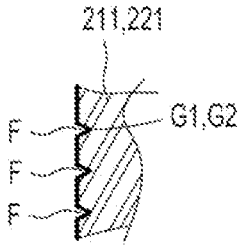
FIG. 8 is a schematic sectional view when the shapes of the cross-sections of the microstructures on a bending punch and a die are V-shaped intersecting grooves according to an embodiment of the present invention.
Figure 9:
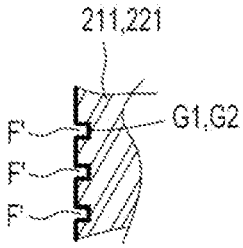
FIG. 9 is a schematic sectional view when the shapes of the cross-sections of the microstructures on a bending punch and a die are square intersecting grooves according to an embodiment of the present invention.
Figure 10:
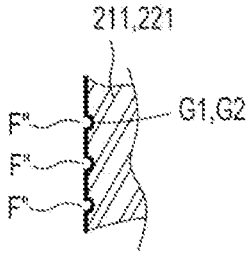
FIG. 10 is a schematic sectional view when the shapes of the cross-sections of the microstructures on a bending punch and a die are arc-shaped intersecting grooves according to an embodiment of the present invention.

Please then refer to FIG. 8, FIG. 9, and FIG. 10, in which FIG. 8 is a schematic sectional view when the shapes of the cross-sections of the microstructures on a bending punch and a die are V-shaped intersecting grooves according to an embodiment of the present invention, FIG. 9 is a schematic view when the microstructures on a bending punch and a die are square intersecting grooves according to an embodiment of the present invention, and FIG. 10 is a schematic view when the microstructures on a bending punch and a die are arc-shaped intersecting grooves according to an embodiment of the present invention. The shapes F of the cross-sections of the intersecting groove microstructures of the microstructures G1 on the die 211 or the microstructures G2 on the bending punch 221 in the embodiment of FIG. 8 are approximately V-shaped, the shapes F' of the cross-sections of the intersecting groove microstructures of the microstructures G1 of the die 211 or the microstructures G2 of the bend punch 221 are square in the embodiment of FIG. 9, and the shapes F" of the cross-sections of the intersecting groove microstructures of the microstructures G1 of the die 211 or the microstructures G2 of the bend punch 221 in the embodiment of FIG. 10 are arc-shaped.

Figure 11:
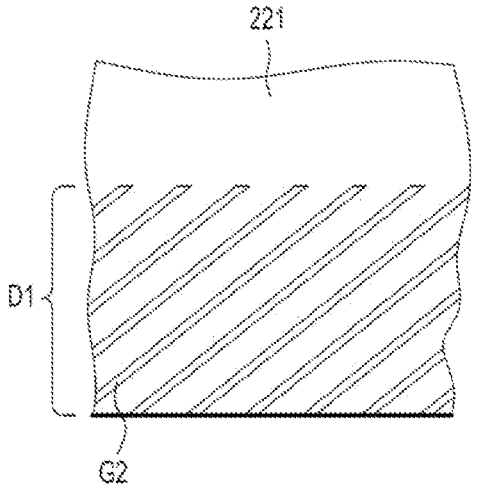
FIG. 11 is a schematic view when microstructures on a bending punch are oblique parallel arrangement according to the present invention.
Figure 12:
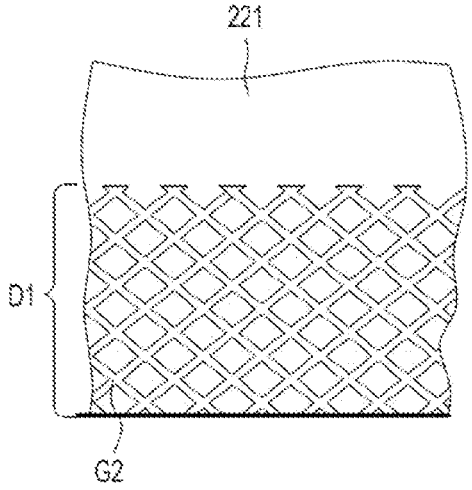
FIG. 12 is a schematic view when microstructures on a bending punch are intersecting arrangement according to the present invention.
Figure 13:
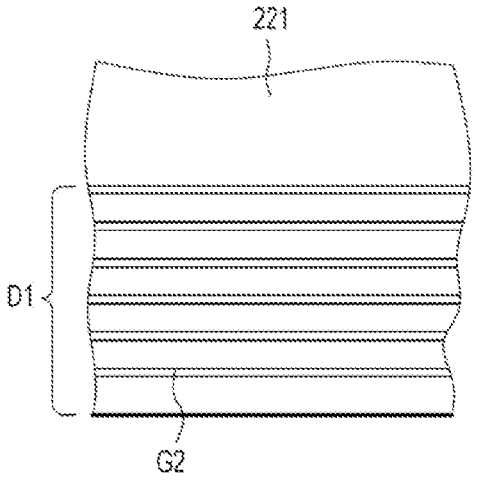
FIG. 13 is a schematic view when microstructures on a bending punch are horizontal parallel arrangement according to the present invention.
Figure 14:
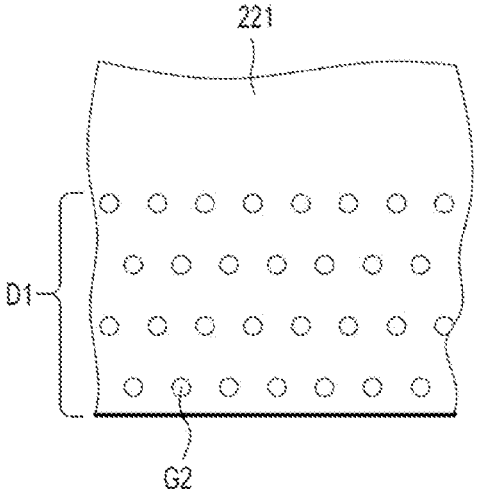
FIG. 14 is a schematic view when concave microstructures on a bending punch are evenly distributed according to the present invention.

Please continue to refer to FIG. 11, FIG. 12, FIG. 13, and FIG. 14, in which FIG. 11 is a schematic view when a plurality of surface microstructures G2 on the turning portion on the bending punch 221 and the neighboring surface region D1 thereof is oblique parallel arrangement relative to the stamping direction of the bending punch 221 according to an embodiment of the present invention, FIG. 12 is a schematic view when a plurality of surface microstructures G2 on the turning portion of the bending punch 221 and the neighboring surface region D1 thereof is intersecting arrangement relative to the stamping direction of the bending punch 221 according to an embodiment of the present invention, FIG. 13 is a schematic view when a plurality of surface microstructures G2 on the turning portion of the bending punch 221 and the neighboring surface region D1 thereof is the arrangement perpendicular to the stamping direction of the bending punch 221 (that is, the arrangement horizontal to each other) according to an embodiment of the present invention, and FIG. 14 is a schematic view when a plurality of surface microstructures G2 in a concave form on the turning portion of the bending punch 221 and the neighboring surface region D1 thereof are evenly distributed according to an embodiment of the present invention.

It should be noted that the intervals between the plurality of surface microstructures G2 may be approximately even distribution, and it is not required that the intervals are completely accurate. Also, the shape of the microstructure surface in a concave form may be circular; however, the present invention is not limited to being circular, and may also be elliptic, square shape and in other shapes. In addition, although the embodiments use the microstructure G2 of the bending punch 221 as an example, they may also be applicable to the setting of microstructures G1 on the die 211.

Figure 15:
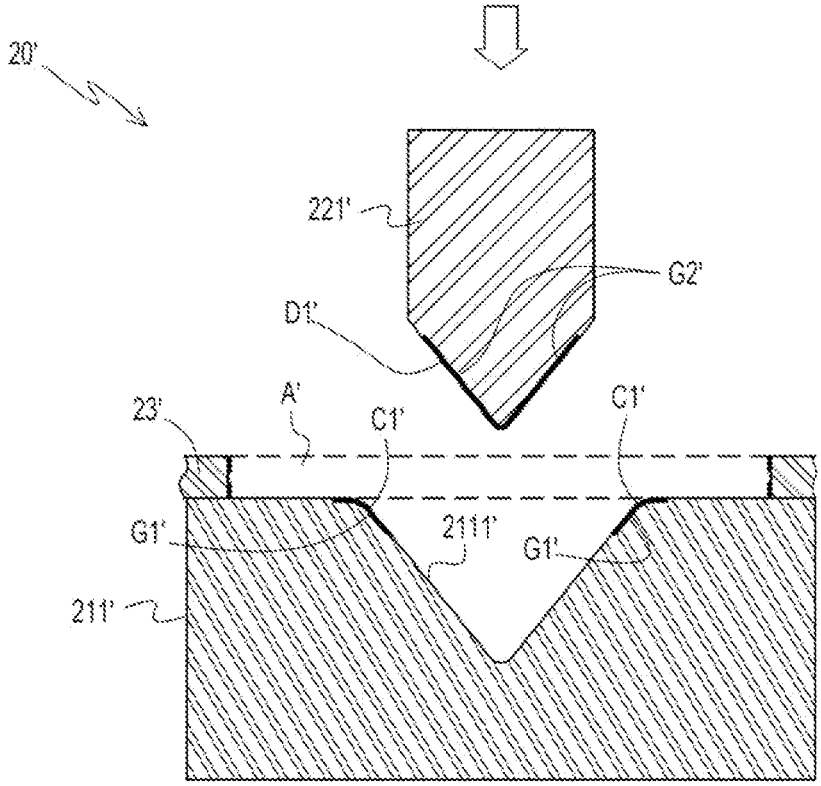
FIG. 15 is a schematic view of the positions of microstructures on the surface of a working portion of a bending punch and a forming surface of a die of a V-shaped bending die according to an embodiment of the present invention.

FIG. 15 is a schematic view of the positions of microstructures on the surface of a working portion of a bending punch and a forming surface of a die of a V-shaped bending die according to the present invention. In the embodiment in FIG. 15, in a bending die 20, a blank A' is positioned on a die 211' with a workpiece placing piece 23' (positioning plate). A bending punch 221' stamps downwards corresponding to the V-shaped forming surface 2111' of the die 211' to perform bending and forming on the blank A'. A plurality of microstructures G1' of the die are disposed on the wall surface turning position of the forming surface 2111' and a neighboring wall surface region C1' thereof. A plurality of microstructures G2' of the bending punch are disposed on the turning portion and a neighboring surface region D1' thereof.

Figure 16:
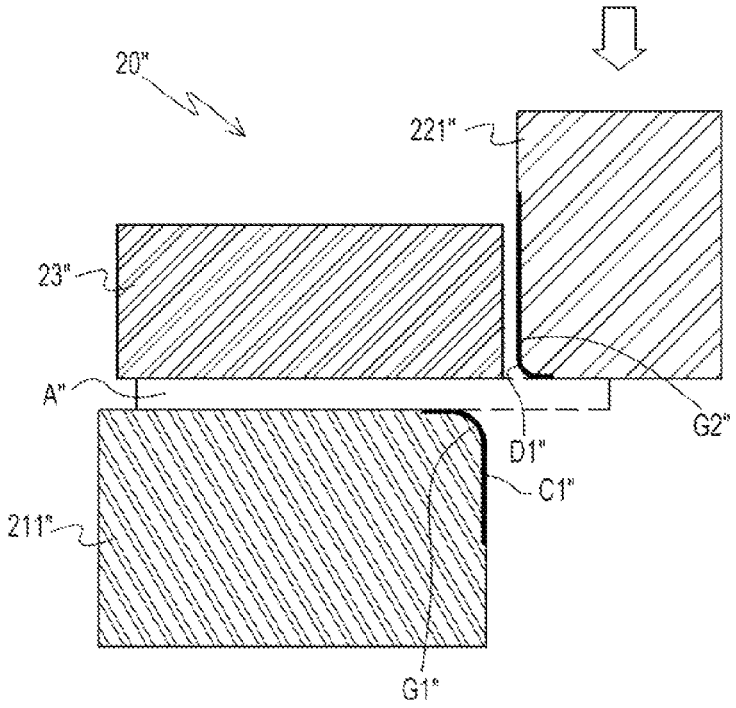
FIG. 16 is a schematic view of the positions of microstructures on the surface of a working portion of a bending punch and a forming surface of a die of an L-shaped bending die according to an embodiment of the present invention.
Figure 17:
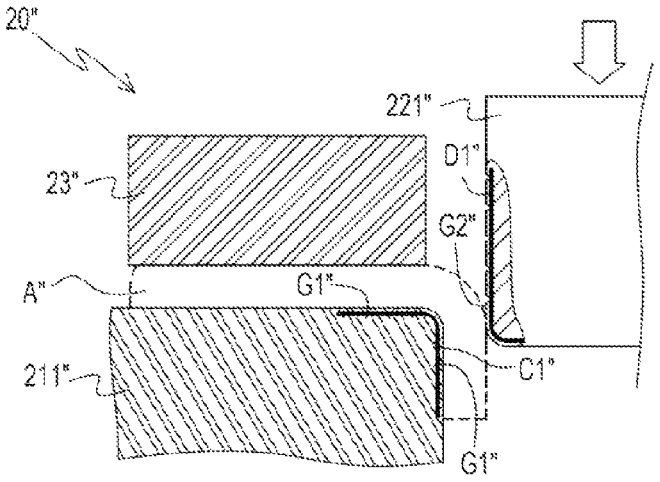
FIG. 17 is a schematic sectional view when the microstructures on the surface of a working portion of a bending punch and a forming surface of a die in FIG. 15 are V-shaped intersecting grooves according to an embodiment.

FIG. 16 is a schematic view of the positions of microstructures on the surface of a working portion of a bending punch and a forming surface of a die of an L-shaped bending die according to the present invention. In the embodiment in FIG. 16, in a bending die 20", a blank A" is pressed and fixed on the die 211" with a workpiece placing piece 23" (blank holder). A bending punch 221" corresponds to the lateral side of an L-shaped forming surface 2111" of a die 211", and stamps downwards to perform bending and forming on the blank A". A plurality of microstructures G1" are disposed on the wall surface turning position of the forming surface 2111" and a neighboring wall surface region C1" thereof A plurality of microstructures G2" are disposed on the turning portion and a neighboring surface region D1" thereof. FIG. 17 is a schematic sectional view of the positions that the plurality of V-shaped microstructures G1" and the plurality of V-shaped microstructures G2" on the turning portion and the neighboring surface region D1" thereof are disposed relative to each other in a processing process.

In an embodiment, an included angle (right angle, acute angle or obtuse angle) may be provided between two adjacent wall surfaces of the wall surface turning position C, and a fillet, a concave angle or an oblique angle may be provided two adjacent wall surfaces, among other aspects.

It should be noted that, in an embodiment, the microstructures on the forming surface and the surface of the working portion may be disposed inclined or perpendicular to the stamping direction, or disposed inclined or perpendicular to the edge of the forming die surface.

In an embodiment, the microstructures are arranged at intervals.

In conclusion, the present invention at least has the following advantages: microstructures disposed on the surface of a working portion of a bending punch, or the surface of a working portion of a bending punch and a forming surface of a corresponding die in the present invention are intersecting grooves disposed inclined relative to the stamping direction, parallel grooves disposed perpendicular to the stamping direction, and various shape slots, and can reduce the force of friction between a processed blank and a bending die during bending, so as to make a sheet metal blank to completely reach plastic deformation during bending and forming, reduce cases of uneven stress distribution on the sheet metal blank, and reduce the springback amount of the sheet metal blank.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A bending die having surface microstructures, applicable to stamping processing to bend a blank to form a shape, the bending die comprising:

a lower die, disposed on a die base, the lower die comprising a die, and the die comprising a forming surface;

an upper die, comprising a bending punch, the bending punch stamping a blank placed on the die in a back and forth stroke, and the bending punch comprising a working portion coming into contact with the blank during stamping; and a workpiece placing piece, disposed between the upper die and the lower die, and used to position or press the blank placed on the die;

wherein a plurality of microstructures are disposed on the forming surface and/or on the surface of the working portion, wherein the plurality of the microstructures are in the pattern of a plurality of grooves or a plurality of concaves or a combination of a plurality of grooves and a plurality of concaves, wherein the plurality of grooves of the microstructures are arranged intersecting each other or parallel to each other.

2. The bending die according to claim 1, wherein the microstructures are arranged at intervals.

3. The bending die according to claim 1, wherein the surfaces of the concave microstructures are approximately circular, elliptic, square or irregular.

4. The bending die according to claim 1, wherein the cross-sections of the microstructures are approximately square, V-shaped or arc-shaped.

5. A bending punch, comprising a working portion in contact with a blank, and surfaces around the working portion comprising a plurality of microstructures, wherein the plurality of the microstructures are in the pattern of a plurality of grooves or a plurality of concaves or a combination of a plurality of grooves and a plurality of concaves, wherein the plurality of grooves of the microstructures are arranged intersecting each other or parallel to each other.

6. The bending punch according to claim 5, wherein the microstructures are arranged at intervals.

7. The bending punch according to claim 5, wherein the surfaces of the concave microstructures are approximately circular, elliptic, square or irregular.

8. The bending punch according to claim 5, wherein the cross-sections of the microstructures are approximately square, V-shaped or arc-shaped.

* * * * *